United States Patent [19]

Apple

[11] 4,081,925

[45] Apr. 4, 1978

[54] FINGER PUPPETS

[76] Inventor: Merrill K. Apple, 863 Linden La., Davis, Calif. 95616

[21] Appl. No.: 718,687

[22] Filed: Aug. 30, 1976

[51] Int. Cl.[2] ..... A63H 3/14

[52] U.S. Cl. ..... 46/116; 46/11; 46/154

[58] Field of Search ..... 46/154, 116, 11, 13

[56] References Cited

U.S. PATENT DOCUMENTS

| | | | |
|---|---|---|---|
| 683,857 | 10/1901 | Kilpatrick | 46/154 |
| 2,725,670 | 12/1955 | Hodes | 46/116 |
| 3,447,165 | 6/1969 | Brosk | 46/116 X |
| 3,778,925 | 12/1973 | Owen | 46/13 |

*Primary Examiner*—F. Barry Shay
*Attorney, Agent, or Firm*—Ernest L. Brown

[57] ABSTRACT

One or more finger puppets positioned in the wall of a preferably transparent enclosure. The enclosure is partly filled with particles of material to selectively hide the finger puppets.

8 Claims, 6 Drawing Figures

FINGER PUPPETS

BACKGROUND OF THE INVENTION

Finger puppets are sheaths for the fingers having a face painted or otherwise written thereon. Sometimes the face is placed directly upon the skin. The puppets may be made of any material but are frequently made of cloth or rubber.

BRIEF DESCRIPTION OF THE INVENTION

The impression to be created by this invention is that a troll or other being lives in a bucket or container of particles. Typical particles to be used are rice hulls, sawdust, sand, and the like. The being may be happy, sad, coy, angry, disturbed, or reflect another emotion. The beings are finger puppets which are manipulated from outside of the container.

The container is preferably transparent so that the finger puppet or puppets can be seen. The wall of the container, and preferably the bottom wall of the container, has an opening for each of the finger puppets. Each finger puppet has an opening in the continer through which a finger may be inserted to manipulate the puppet.

The container contains the above-mentioned particles which initially typically cover the puppet so that the viewer does not see the puppet. The operator then moves the container to move the particles inside, whereby the finger puppet gradually becomes visible.

If the puppets are made of rubber or other resilient material, they may be made to rise up through the material as if poking their heads up to look around.

It is therefore an object of this invention to produce a novel configuration of finger puppet(s).

It is another object of this invention to insert finger puppet(s) into a container and to cover them with particulate matter.

It is still another object of this invention to insert finger puppet(s) through the wall of a container having particulate material inside.

Other objects will become apparent from the following description, taken in connection with the accompanying drawings, in which:

DETAILED DESCRIPTION OF THE INVENTION

Figure 1:
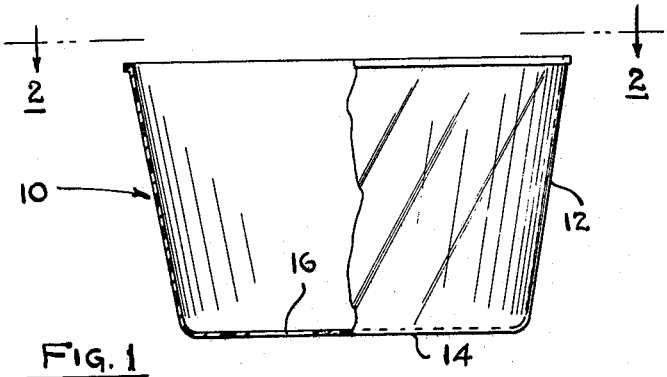
FIG. 1 is a side view of a container, partly in section.
Figure 2:
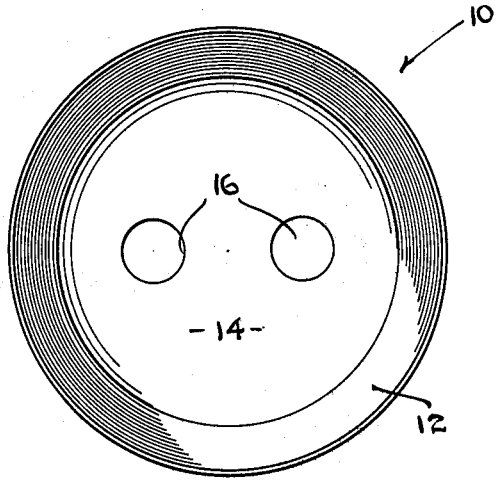
FIG. 2 is a top plan view of the container of FIG. 1, showing two openings in the bottom for the insertion of finger puppets.

Referring to the drawings, FIGS. 1 and 2 show a typical transparent plastics container of the type commonly found in grocery store. The container 10 has a wall portion 12 with two openings 16 formed in the bottom thereof to receive finger puppets. Although two openings are shown, one opening is more frequent, and additional openings for additional puppets may be added if desired. Two finger puppets 20 are shown inserted through the holes 16 in the bottom 14 of the container. Each finger puppet has a hollow wall portion 24 upon which a face is painted at the end. The wall portion 24 is preferably flexible and is made of rubber. It is within the contemplation of this invention, however, to have non-flexible walls 24. The finger of an operator may be inserted into the body portion 22 to manipulate the puppet.

In one embodiment, not shown, the margin of the puppet wall 24 is folded over the bottom wall 14 and glued. Unfortunately, excess stress in the puppet causes the margin to break free. To prevent the breaking free of the puppet, a reinforcing rim 26 is provided on the margin of the puppet.

In the preferred and shown embodiment, a glue joint of puppet 20 and bottom wall 14 is made at 28. A separate reinforcing ring 36 having a shank or body portion 38 and a flange 40 is inserted into the finger puppet opening 16 after the glue is set. In one embodiment, (not shown), the ring 36 does not have a flange. The ring 36 allows the finger of the user to enter the puppet without disturbing the glued joint 28. Further, the ring intself reinforces the puppet 20.

Particulate material 30 such as rice hulls, sawdust, or sand, and the like are placed in the container 10 and normally covering the puppets 20. A lid 32, preferably transparent, covers 10.

Figure 3:
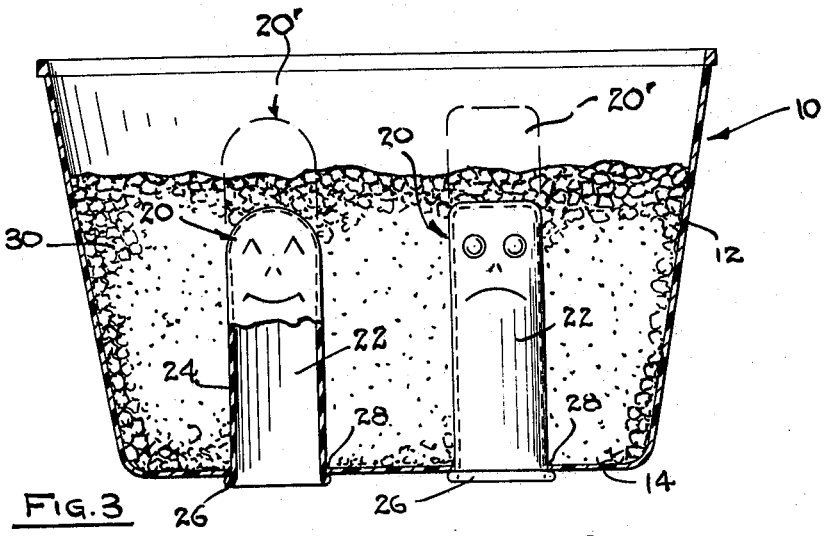
FIG. 3 is an enlarged vertical section of the container with the puppets installed.
Figure 5:
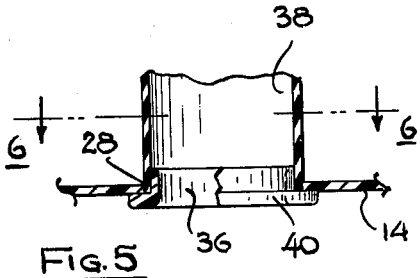
FIG. 5 is a sectional view of the intersection of a finger puppet and the container, showing a reinforcing ring.
Figure 4:
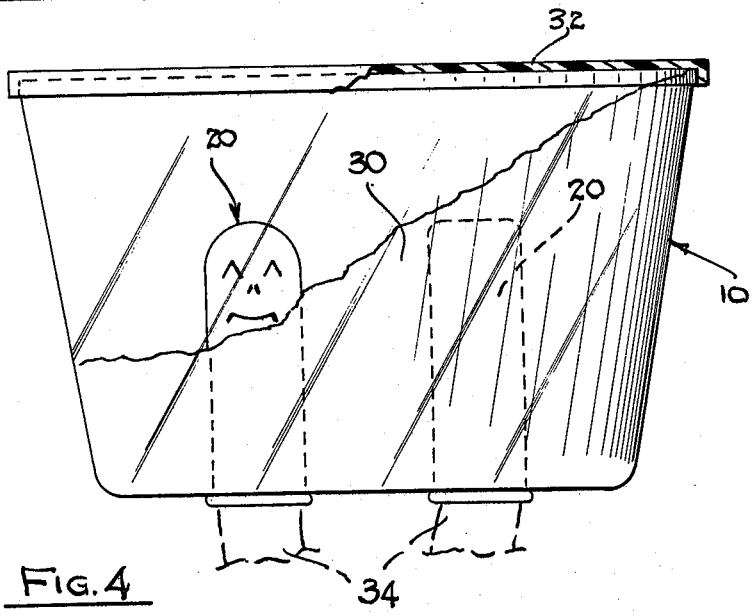
FIG. 4 is an exterior elevation view of a transparent container with puppets installed.
Figure 6:
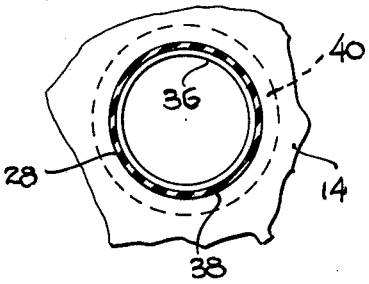
FIG. 6 is a sectional view taken at 6—6 in FIG. 5.

In use, the operator places his finger or fingers into the puppet body 22 and rocks the container to disturb the particulate material 30, therefy disclosing the puppets 20. When the puppets 20 are flexible, the finger may be used to stretch the puppets above the particulate 30 as shown by 20' in FIG. 3.

Thus, to the onlooker it appears that there is a creature living in the particulate, and the creature may be summoned or made to appear by calling or disturbing it.

Although the invention has been described in detail above, it is not appropriate to limit the invention by that description, but rather by that description taken together with the accompanying claims.

I claim:

1. In combination:

a container;

at least one finger hole formed in a wall of said container;

at least one elastic finger puppet, equal in number to said holes, positioned through said finger holes and within the interior of said container;

means for sealing said finger puppets to the periphery of said holes; and particles within said container sufficient to cover said puppets when said puppets are in their unstretched condition.

2. A combination according to claim 1 and further comprising reinforcing collars, one within each of the said holes, for reinforcing the joints between said puppets and said container.

3. A combination according to claim 2 in which said finger holes are in the bottom of said container.

4. A combination according to claim 3 in which at least part of said container is transparent.

5. A combination according to claim 4 and further comprising a transparent lid on said container.

6. In combination:

a container;

at least one finger hole formed in at least one wall of said container;

at least one finger puppet, equal in number to said holes, positioned through said finger holes, and being capable of occupying extended and relatively less extended positions within the interior of said container;

means for sealing said finger puppets to the periphery of said holes; and particles within said container sufficient to cover said puppets when said puppets are in their less extended position.

7. A combination according to claim 6 in which said container is at least partly transparent.

8. A combination according to claim 7 in which said container further comprises a lid which is transparent.

* * * * *